US005281104A

United States Patent [19]

Bublitz

[11] Patent Number: 5,281,104

[45] Date of Patent: Jan. 25, 1994

[54] SEQUENTIAL DISPLACEMENT PISTON PUMP

[75] Inventor: Heiko Bublitz, Stuttgart, Fed. Rep. of Germany

[73] Assignee: Mercedes-Benz AG, Fed. Rep. of Germany

[21] Appl. No.: 931,955

[22] Filed: Aug. 19, 1992

[30] Foreign Application Priority Data

Aug. 22, 1991 [DE] Fed. Rep. of Germany ..... 4127751

[51] Int. Cl.[5] ..... F04B 1/04

[52] U.S. Cl. ..... 417/273; 417/271; 92/12.1; 92/72; 91/491

[58] Field of Search ..... 417/273, 271; 92/72, 92/148, 12.1; 91/495, 491, 492

[56] References Cited

U.S. PATENT DOCUMENTS 2,423,701 7/1947 Hardy .
3,808,951 5/1974 Martin ..... 91/492
5,100,305 3/1992 Zirps ..... 417/273

FOREIGN PATENT DOCUMENTS 1207707 12/1975 Fed. Rep. of Germany .

*Primary Examiner*—Richard A. Bertsch
*Assistant Examiner*—Alfred Basichas
*Attorney, Agent, or Firm*—Evenson, McKeown, Edwards & Lenahan

[57] ABSTRACT

A piston pump is constructed so that the displacer or piston working strokes occur in sequence with varying phase differences which have a non-integral ratio to one another. Thereby, the risk of excitation of noise or resonance vibrations is greatly reduced.

3 Claims, 2 Drawing Sheets

SEQUENTIAL DISPLACEMENT PISTON PUMP

BACKGROUND AND SUMMARY OF THE INVENTION

The present invention relates to a displacer unit, and, in particular, a piston pump with a plurality of displacers or pistons which carry out sequential displacer or piston working strokes.

In fluid and hydraulic systems of motor vehicles, pumps piston, which are usually configured as radial piston pumps, are used for supplying different consumption units. In addition to being functionally reliable, it is also important that the pump should operate with low noise in order to permit comfortable driving in the vehicle.

To avoid noise, account must be taken of the fact that the pump must operate at greatly varying speeds depending on the operating conditions of the vehicle and the speed of the vehicle engine and, as far as possible, low-noise operation should be possible at all speed ranges.

In connection with the reduction of operating noise in a vehicle, it is known in principle to encapsulate units causing noise in a sound insulating manner or to arrange them in such a way that the noise cannot be transmitted, or can only be transmitted to a small proportion, to other components or sub-assemblies of the vehicle.

Nevertheless, it remains a desirable target to employ, as far as possible, such units as produce particularly low noise so that the measures mentioned above become unnecessary to the greatest possible extent.

A radial piston pump with three pistons is shown in DE-B 12 07 707 which is actuated by a cam ring with five cam-shaped protrusions. Two of the pistons have the same cross-sections and are located with their axes at an angle of approximately 72° to one another. The third piston has approximately 1.6 times the cross-section of the two other pistons and is located with its axis symmetrical to the piston axes of the two other pistons. Because of this arrangement, all the pistons execute their compression or suction stroke simultaneously, i.e. all the pistons are simultaneously moved radially inwards or radially outwards. Because of the arrangement and the dimensions of the pistons, the reaction torques occurring are mutually compensating, i.e. the housing of this known pump is only excited to relatively small vibrations by the pump work.

Another radial piston pump is known from U.S. Pat. No. 2,423,701 whose pistons are actuated by a central cam wheel with three cams. Different piston arrangements are possible depending on the desired pump output. In one embodiment, two diametrically opposite and coaxial pistons are associated with the cam wheel. In another embodiment, the cam wheel actuates a total of four pistons which are opposite to one another in pairs, with the pistons of each pair having a common piston axis. The piston axes of pistons adjacent to one another in the direction of rotation of the cam wheel form a right angle in each case. Finally, a third embodiment is shown in which the cam wheel interacts with three pistons, of which two coaxial pistons are diametrically opposite to one another. The third piston is arranged transverse to the two coaxial pistons and its piston axis forms a right angle with each of the piston axes of the two other pistons.

Even though the previously known piston pumps operate, in some cases, with very little vibration, undesirable noise still appears during operation, particularly in motor vehicles.

An object of the present invention is, therefore, to produce a construction which leads to a substantial reduction in noise. This object has been achieved, according to the present invention in a displacer unit or a piston pump in which there are varying phase differences between working strokes occurring sequentially in time, with these phase differences having a non-integral ratio with one another.

The present invention is based on the recognition that an essential cause of the noise developed by displacer units and piston pumps is that pressure pulsations necessarily appear in the pipework system connected to the displacer unit or piston pump. In the case of piston pumps, this applies particularly to the pressure pulsations on the pressure side of the pump. These pressure pulsations can lead to noise at very remote locations, particularly when natural frequencies are excited there of vibrating components or units. In motor vehicle, for examples, body parts can be excited to vibration relatively easily even at a large distance from a hydraulic pump if these body parts are located near fluid pipes in which pressure pulsations can occur at a critical frequency. An additional difficulty is that in motor vehicles, the pumps are usually driven directly by the vehicle engine and therefore run with varying speed depending on the particular vehicle speed. The risk that the pressure pulsations caused by the pump may have a critical frequency for some parts of the body, at least in certain speed ranges, is very great.

Because, in accordance with the present invention, there are different time intervals between sequential working strokes of the displacer unit or the piston pump, and since the length of these time intervals have a non-integral ratio with one another, this arrangement at least avoids the possibility of the pressure pulsations having a frequency spectrum in which the frequencies of higher harmonics are excited in addition to the fundamental vibration frequency. What is, in fact, excited is a mixture of frequencies whose constituents cannot mutually amplify one another so that the formation of resonances is quite substantially limited.

The invention can be fundamentally effected in the case of very different types of displacer unit or piston pump configurations. In a piston pump with cylinders arranged in line, for example, a crankshaft can be provided whose cranks can form appropriately different angles, in an axial view onto the shaft, so that the piston strokes follow sequentially with varying phase differences.

Pistons or displacers driven by eccentric or cam units can have a multiplicity of eccentric regions or cams which are so arranged that, for a constant driving speed, they become effective as driving elements with different time intervals between them.

In a particularly preferred embodiment of the present invention, a piston pump is configured as a radial piston pump, with at least some of the cylinders thereof associated with the pistons being arranged at different angles relative to one another so that there are correspondingly varying phase differences between working strokes which are sequential in time.

BRIEF DESCRIPTION OF THE DRAWINGS

These and other objects, features and advantages of the present invention will become more apparent from the following detailed description of currently preferred embodiments when taken in conjunction with the accompanying drawings wherein.

DETAILED DESCRIPTION OF THE DRAWINGS

Figure 1:
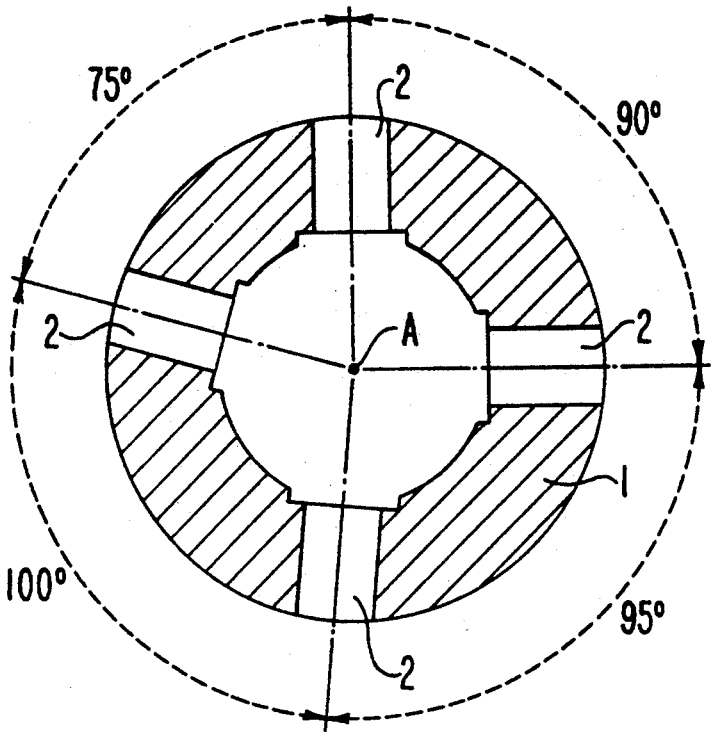
FIG. 1 is a radial sectional view of a housing part accommodating the cylinder bores of a radial piston pump according to the present invention.

A housing part 1, shown in FIG. 1, of a radial piston pump has a total of four cylinder bores 2 in which conventional pump pistons (not shown) are accommodated, these being in turn actuated by a conventional eccentric (not shown) rotating about an axis A of the housing part 1. The axes of the cylinder bores 2 include angles of varying magnitude of 90°, 95°, 100° and 75°. The working strokes of the pistons to be accommodated in the cylinder bores 2 correspondingly follow one another with varying phase differences and this is so even when the driving speed of the eccentric or its rotational speed remain unaltered.

As a consequence, the pressure pulsations caused by the working strokes of the pistons on the pressure side of the pump follow one another at correspondingly varying time intervals so that the danger of resonance excitation is substantially reduced. An advantage of the radial piston pump configuration shown in FIG. 1 is that its construction remains substantially unaltered and, in particular, no complicated manufacturing steps are necessary. It is sufficient for the cylinder bores 2 in the housing part 1 to be arranged in the manner shown. The other parts of the pump, and their mode of assembly, remain unaltered.

Figure 2:
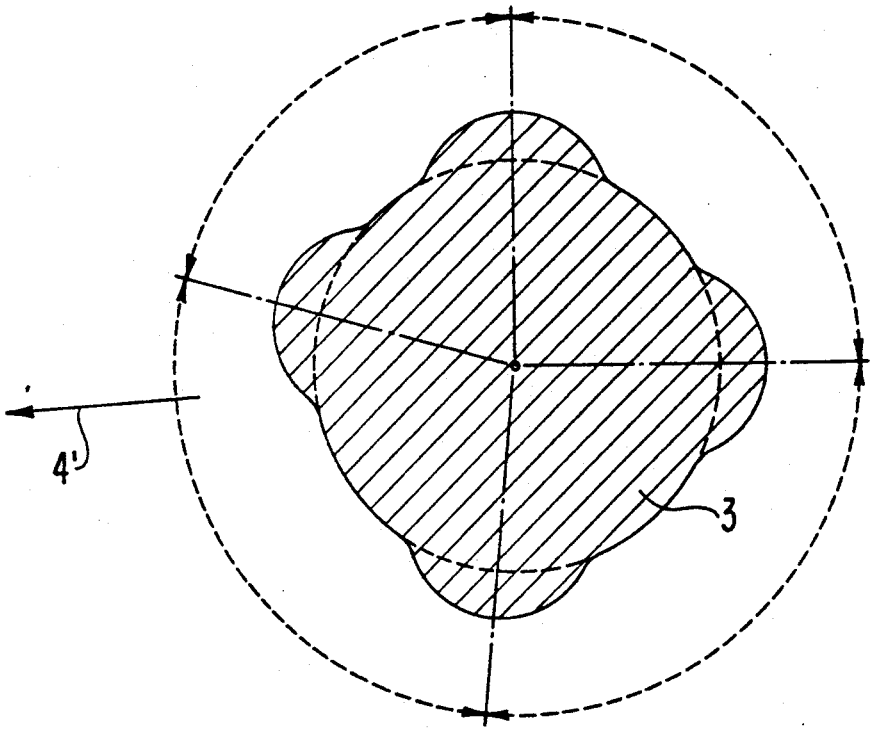
FIG. 2 is a cam wheel used, in a manner according to the present invention, for actuating one or a plurality of pistons.
Figure 3:
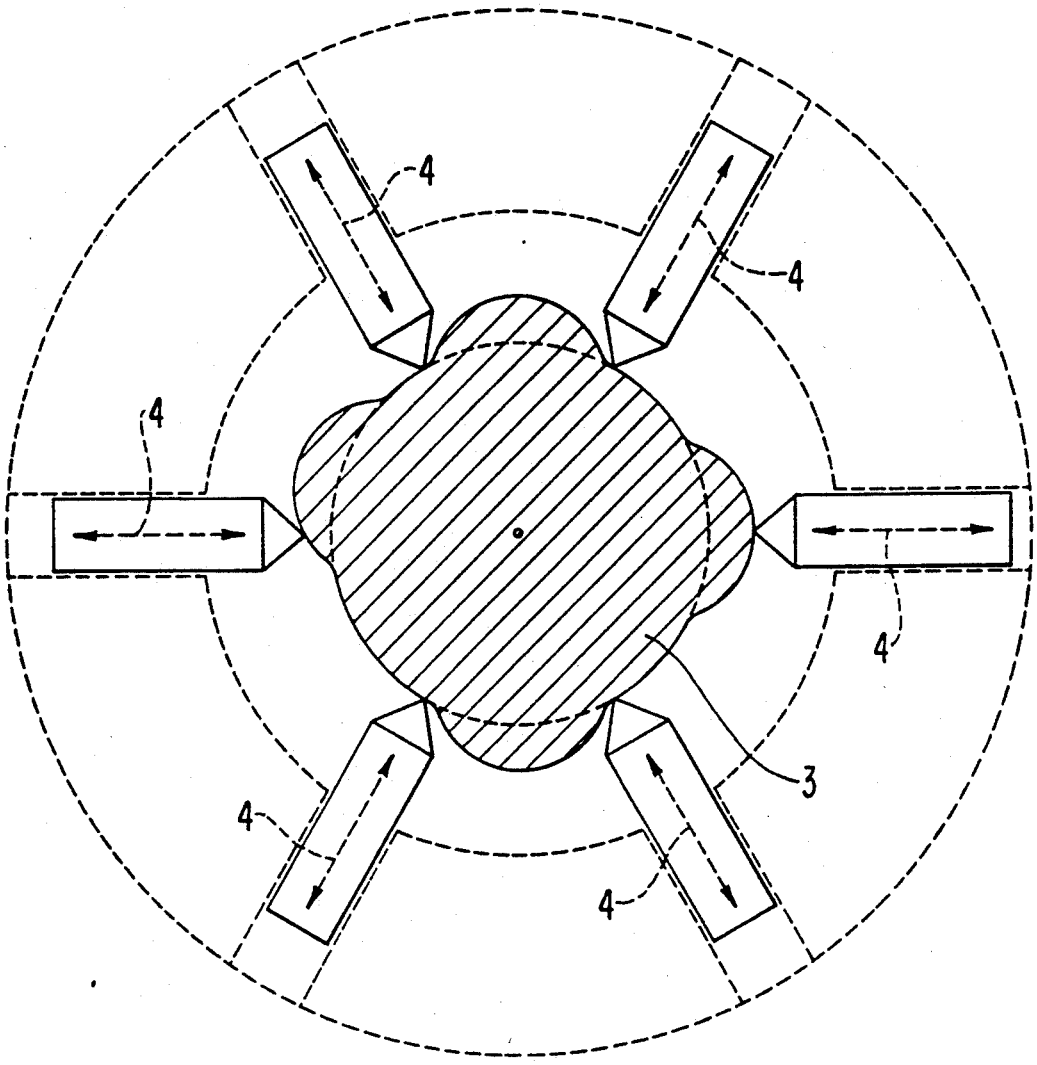
FIG. 3 is a view similar to FIG. 2 but with known types of pistons shown schematically to interact with the ring surface of the eccentric.

A similar result can be achieved in the case of a radial piston pump if its pistons 4 are driven by a specially shaped eccentric such as is shown, for example, in FIGS. 2 and 3. This eccentric 3 has a total of four cams which are located at different angles relative to one another, as viewed along the axis of the eccentric 3, of 90°, 95°, 100° and 75°. If the eccentric 3 now interacts with a piston whose piston axis 4' is shown as a solid line, the working strokes of the piston follow one another at varying time intervals. The same also applies when the arrangement includes a plurality of pistons, even if adjacent piston axes are arranged at the same angle to one another.

Instead of an eccentric 3 which interacts with the piston or pistons by way of its external surface, it is fundamentally also possible to have an arrangement with an annular part which interacts with the piston or pistons by an eccentric internal peripheral surface.

Although the invention has been described and illustrated in detail, it is to be clearly understood that the same is by way of illustration and example, and is not to be taken by way of limitation. The spirit and scope of the present invention are to be limited only by the terms of the appended claims.

I claim:

1. A radial piston pump, comprising a plurality of pistons and a driving element rotatably mounted relative to the pistons, said driving element having a ring surface with a plurality of eccentric regions, said pistons opertively arranged to interact with said ring surface and the eccentric regions thereof for effecting sequential working strokes with sequential phase differences therebetween, said eccentric regions being located at angles different from one another as viewed along a central axis of said driving element, such that said angles have a non-integral ration with respect to one another and thereby cause the sequential phase differences of the working strokes to have a respective ratio.

2. The piston pump according to claim 1, wherein the pump has at least certain piston axes, as viewed along the axis of the pump, at different angles.

3. The positive displacement unit according to claim 1, wherein the driving element is one of an eccentric, a cam wheel and a cam ring.

* * * * *